US006729099B2

(12) United States Patent
Hazama

(10) Patent No.: US 6,729,099 B2
(45) Date of Patent: May 4, 2004

(54) CONCRETE EMBEDDING ANCHOR, FITMENT FOR THE SAME AND METHOD OF MANUFACTURING CONCRETE MOLDED PIECE USING THE SAME

(75) Inventor: Kiyoshi Hazama, Higashi-Osaka (JP)

(73) Assignee: Flex System Co., Ltd., Osaka (JP)

( * ) Notice: Subject to any disclaimer, the term of this patent is extended or adjusted under 35 U.S.C. 154(b) by 68 days.

(21) Appl. No.: 09/746,587

(22) Filed: Dec. 21, 2000

(65) Prior Publication Data

US 2001/0004824 A1 Jun. 28, 2001

(30) Foreign Application Priority Data

Dec. 28, 1999 (JP) ..... 11-372560
Apr. 3, 2000 (JP) ..... 2000-101137
Oct. 13, 2000 (JP) ..... 2000-314503

(51) Int. Cl.[7] ..... E04B 1/38; E04C 5/00
(52) U.S. Cl. ..... 52/704; 52/699; 52/700; 52/701; 52/125.5; 411/5; 411/2; 411/3
(58) Field of Search ..... 52/699, 700, 701, 52/125.5, 704; 411/5, 2, 3

(56) References Cited

U.S. PATENT DOCUMENTS 3,391,514 A * 7/1968 Hall, Jr. ..... 52/699
4,087,947 A * 5/1978 Turner ..... 294/90
5,433,570 A * 7/1995 Koppel ..... 411/387.1
5,528,867 A * 6/1996 Thompson ..... 52/125.2

FOREIGN PATENT DOCUMENTS

| | | |
|---|---|---|
| JP | H2-146306 | 6/1990 |
| JP | H2-176040 | 7/1990 |
| JP | H6-20606 | 3/1994 |
| JP | H11-198117 | 7/1999 |

* cited by examiner

*Primary Examiner*—Carl D. Friedman
*Assistant Examiner*—Steve Varner
(74) *Attorney, Agent, or Firm*—Koda & Androlia

(57) ABSTRACT

A concrete embedding anchor includes. An anchor including an anchor body having a head at one end of the shank and a stopper at the other end, a fitment concentrically mounted to said head and having an external thread and easy breaking portion formed on the round bar portion thereof, and a hemispherical shell-shaped former fitted with the middle portion of said anchor shank. A retainer is secured to the concrete form in advance, said anchor fitment is inserted into and screwed up to said retainer, said anchor is combined with the concrete form, then concrete is poured, and said concrete form is taken away after the concrete has hardened.

19 Claims, 11 Drawing Sheets

CONCRETE EMBEDDING ANCHOR, FITMENT FOR THE SAME AND METHOD OF MANUFACTURING CONCRETE MOLDED PIECE USING THE SAME

BACKGROUND OF THE INVENTION

The present invention relates to anchors which are embedded in concrete when concrete molded pieces such as concrete panels or blocks are manufactured in the factory fitment for the same and a method of manufacturing molded pieces in which said anchors have been embedded.

It is known that a lifting anchor engaged with a lifting appliance is embedded in the surface of a concrete molded piece. Conventionally, as shown in FIGS. 8 and 9, a former P1 is a rubber-made hemispherical article with a cut P11 formed on the diameter passing through the top of the spherical surface from the top to near the bottom. Said former can be split (opened) along the cut. The split former is caught in the head of an anchor P2, and mounted to a concrete form F by means of a fastener P3 such as bolt or nut.

Now, this specific operating method will be described with reference to FIG. 10. When the anchor P2 is embedded in the side face, a hole for receiving the bolt of the former P1 is opened beforehand in the concrete form F placed in a position in which the anchor is embedded. The former P1 is opened, the head of anchor P2 is inserted into the former, a bolt is fitted into the hole of concrete form F, a butterfly nut is screwed onto the bolt until the anchor has been fixedly secured to the concrete form F. Concrete forming takes place thereafter. When the concrete form is removed, as shown in FIG. 11, the butterfly nut is taken away, then the concrete form F is removed, then as shown in FIG. 12, rods P4 are inserted into two holes provided in the bottom face of the former P1, and when these two rods are crossed each other, the former opens and is ready to leave the head of the anchor, and then, the former is removed.

However, in such a method if broad concrete forms are used, two operators must be employed, that is, one operator carrying anchors must stand inside of the concrete form and the other one carrying bolts outside thereof. I addition, the operators must conduct positional alignment operations respectively inside and outside of the concrete form, which things result in inefficient operation.

Furthermore, when the concrete form is taken away, for example, in case of box-shaped molded pieces, the operator must enter into the concrete form in order to remove the bolts. In case the space of the interior is very limited, the operation is unlikely to be done efficiently and involves some risks. Thus, it may happen that the inside space of the concrete form is so narrow that it is impossible or difficult for the operator to enter the inside of the inner form.

SUMMARY OF THE INVENTION

The object of the present invention is to solve said tasks and provide concrete embedding anchors, a fitment for the same which are easy to mount and to dismount from the concrete forms and a method of manufacturing concrete molded pieces using the same.

For the purpose of solving said tasks, the present invention consists of the following constructions. Namely, a first construction of a concrete embedding anchor includes an anchor body having ahead formed in one end of a shank thereof and a stopper in the other end, a fitment concentrically mounted to the head and having an external thread and easy breaking portion formed on a round bar portion thereof, and a former fitted onto said anchor shank.

A second construction of a concrete embedding anchor includes an anchor body having a head formed in one end of the shank and a stopper in the other end, a fitment concentrically mounted to the head and having an external thread and easy breaking portion formed on the round bar portion, and a former removably fitted onto said anchor shank, said former being in the shape of a hemisphere, and having a cut so formed on the diameter passing through the top of the sphere from the top to near the bottom portion that the former can be opened and shut at said cut, and that said anchor head may be passed through the opened cut, and then encased in the former.

A third construction of a concrete embedding anchor includes an anchor body having a head formed in one end of the shank and a stopper in the other end, a fitment concentrically mounted to the head and having an external thread and easy breaking portion formed on the round bar portion, a positioning member fixed to the middle portion of said anchor shank, and a former engaged with said positioning member.

A fourth construction of a concrete embedding anchor, in addition to the third construction, is arranged such that said former is a hemispherical shell-shaped object.

A fifth construction of a concrete embedding anchor, in addition to the third construction, is arranged such that said former is in the shape of a hemisphere.

A sixth construction of a concrete embedding anchor, in addition to any of the first, second, and third constructions, is arranged such that the external thread formed on the round bar portion of said fitment is shorter than one pitch.

A seventh construction of a concrete embedding anchor, in addition to the fourth construction, is arranged such that the former is tapered on the end thereof, which becomes lower inwardly and radially.

A eighth construction of a concrete embedding anchor, in addition to the fourth construction, is arranged such that the former has a circumferential groove formed in an internal position near the end thereof to extend substantially in parallel with the end.

A ninth construction of a concrete embedding anchor, in addition to the fourth construction, is arranged such that the former has a fitting hole formed on the radius passing through the spherical top and spherical center and concentrical therewith, said fitting hole being slightly larger than said anchor head in diameter, and having circumferential raised and depressed streaks which may attach to and detach from by deforming elastically, another circumferential raised and depressed streaks which may attach to and detach from said streaks by deforming elastically is provided on said positioning member.

A tenth construction of a concrete embedding anchor, in addition to the fourth construction, is arranged such that a cap having a circumferential raised streak which may removably fit in the circumferential groove of said former has been fitted in the circumferential groove of said former.

An eleventh construction of a concrete embedding anchor includes an anchor body having a head at one end of the shank and a stopper at the other end, a positioning member fixed to the middle portion of said anchor shank, and a former fitted to said positioning member.

A twelfth construction of a concrete embedding anchor includes an anchor body having a head at one end of the shank and a stopper at the other end, and a positioning member fixed to the middle portion of said anchor shank.

A thirteenth construction of a concrete embedding anchor in addition to the third or fourth or fifth or sixth or ninth construction includes, said fitment and said positioning member being removably fitted onto said head and said shank of said anchor body, and having a base portion covering said head, a round bar portion following said base portion, an external thread formed on said outer periphery of said round bar portion, an easy breaking portion of a smaller-diameter cross section provided near said border between said base portion and said round bar portion, a joining cylinder part connected to said base portion, and a positioning part connected to said base portion via said joining cylinder part, and being splitted on a plane including it's axis, and able to split and combine by male and female joint of elastic deformation.

A fourteenth construction of a concrete embedding anchor in addition to the third or fourth or fifth or sixth or ninth construction includes, said fitment and said positioning member being removably fitted onto said head and said shank of said anchor body, and having a base portion covering said head, a round bar portion following said base portion, an external thread formed on said outer periphery of said round bar portion, an easy breaking portion of a smaller-diameter cross section provided near said border between said base portion and said round bar portion, a joining cylinder part connected to said base portion, and a positioning part connected to said base portion via said joining cylinder part, said base portion, said joining cylinder part and said positioning part being splitted on a plane including their axis, against said base portion, different cylindrical part formed by said round bar portion, said external thread and said smaller-diameter cross section being removably fitted, by means of a connecting thread composed of an internal thread and an external thread splitted integrally formed with said base portion, A fifteenth construction of a fitment for a concrete embedding anchor includes, said fitment being removably fitted onto an anchor body having a head formed in one end of a shank thereof and a stopper in the other end, and having a base portion covering said head, a round bar portion following said base portion, an external thread formed on said outer periphery of said round bar portion, an easy breaking portion of a smaller-diameter cross section provided near said border between said base portion and said round bar portion, a joining cylinder part connected to said base portion, and a positioning part connected to said base portion via said joining cylinder part, and being splitted on a plane including it's axis, and able to split and combine by male and female joint of elastic deformation.

A sixteenth construction of a fitment for a concrete embedding anchor includes, said fitment being removably fitted onto an anchor body having a head formed in one end of a shank thereof and a stopper in the other end, and having a base portion covering said head, a round bar portion following said base portion, an external thread formed on said outer periphery of said round bar portion, an easy breaking portion of a smaller-diameter cross section provided near said border between said base portion and round bar portion, a joining cylinder part connected to said base portion, and a positioning part connected to said base portion via said joining cylinder part, said base portion, said base portion, said joining cylinder part and said positioning part being splitted on a plane including their axis, against said base portion, different cylindrical part formed by said round bar portion, said external thread and said smaller-diameter cross section being removably fitted, by means of a connecting thread composed of an internal thread and an external thread splitted integrally formed with said base portion, A seventeenth construction of a method of manufacturing concrete molded piece using a concrete embedding anchor includes, utilizing an anchor including an anchor body having a head at one end of the shank and a stopper at the other end, a fitment concentrically mounted to said head and having an external thread and easy breaking portion formed on the round bar portion thereof, and a hemispherical shell-shaped former fitted with the middle portion of said anchor shank.

A retainer is secured to the concrete form in advance, said anchor fitment is inserted into and screwed up to said retainer, said anchor is combined with the concrete form, then concrete is poured, and said concrete form is taken away after the concrete has hardened.

A eighteenth construction of a method of manufacturing concrete molded piece using a concrete embedding anchor includes, utilizing an anchor including an anchor body having a head at one end of the shank and a stopper at the other end, a fitment concentrically mounted to said head and having an external thread and easy breaking portion formed on the round bar portion thereof, a positioning member fixed to the middle portion of said anchor shank, and a former removably fitted to said positioning member.

A retainer is secured to the concrete form in advance, said anchor fitment is inserted into and screwed up to said retainer, said anchor is combined with the concrete form, then concrete is poured, said concrete form is taken away after the concrete has hardened, and then, said former left behind in a molded piece is removed.

A nineteenth construction of a method of manufacturing concrete molded piece using a concrete embedding anchor includes, (a) utilizing an anchor including an anchor body having a head at one end of the shank and a stopper at the other end, a fitment having a positioning part, a former removably fitted to said positioning part, said fitment being removably fitted onto said head and said shank of said anchor body, and having (1) a base portion covering said head, (2) a round bar portion following said base portion, (3) an external thread formed on said outer periphery of said round bar portion, (4) an easy breaking port ion of a smaller-diameter cross section provided near said border between said base portion and said round bar portion, (5) a joining cylinder part connected to said base portion, (6) and a positioning part connected to said base portion via said joining cylinder part, (7) and being splitted on a plane including it's axis, and able to split and combine by male and female joint of elastic deformation, (b) securing retainer to the concrete form in advance, (c) inserting said anchor fitment into and screwing up to said retainer, combining with the concrete form, (d) pouring concrete, (e) taking away said concrete form after the concrete has hardened, (f) and removing said former and said fitment left behind in a molded piece.

A twentieth construction of a method of manufacturing concrete molded piece using a concrete embedding anchor includes, (a) utilizing an anchor including an anchor body having a head at one end of the shank and a stopper at the other end, a fitment having a positioning part, a former removably fitted to said positioning part, said fitment being removably fitted onto said head and said shank of said anchor body, and having (1) a base portion covering said head, (2) a round bar portion following said base portion, (3) an external thread formed on said outer periphery of said round bar portion, (4) an easy breaking portion of a smaller-diameter cross section provided near said border between said base portion and said round bar portion, (5) a joining cylinder part connected to said base portion, (6) and a positioning part connected to said base portion via said joining cylinder part, (7) said base portion, said joining cylinder part and said positioning part being splitted on a plane including their axis, (8) against said base portion, different cylindrical part formed by said round bar portion, said external thread and said smaller-diameter cross section being removably fitted, by means of a connecting thread composed of an internal thread and an external thread splitted integrally formed with said base portion, (b) securing retainer to the concrete form in advance, (c) inserting said anchor fitment into and screwing up to said retainer, combining with the concrete form, (d) pouring concrete, (e) taking away said concrete form after the concrete has hardened, (f) and removing said former and said fitment left behind in a molded piece.

DETAILED DESCRIPTION OF THE INVENTION

Figure 1:
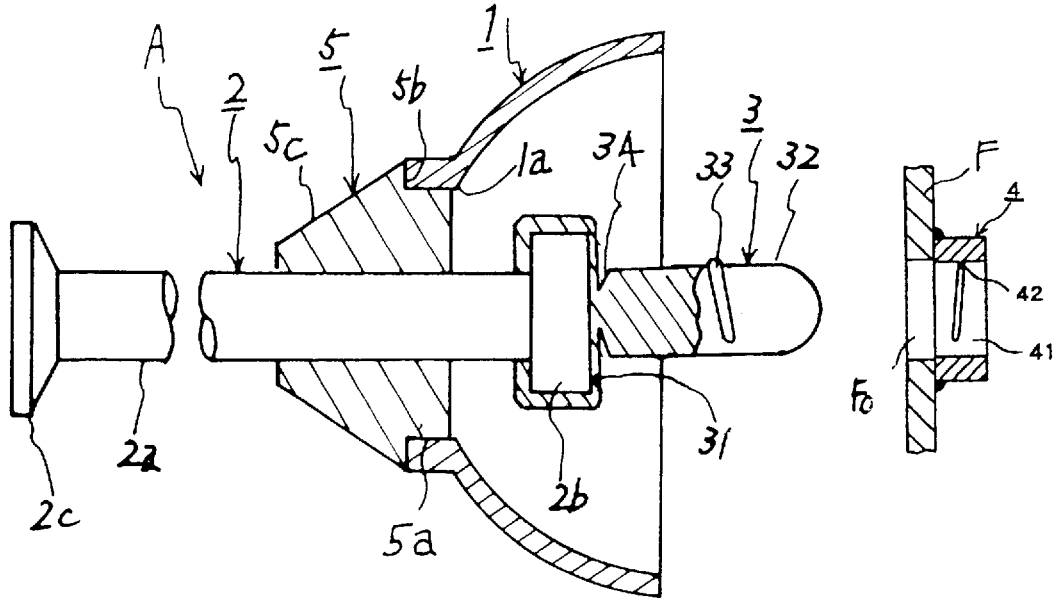
FIG. 1 is a longitudinal sectional view showing one embodiment of the present invention.

The embodiments of the present invention will be described with reference to the respective examples as shown in the drawings. In FIG. 1, an embedding anchor A comprises a former 1, an anchor body 2, a fitment 3, and a positioning member 5. The anchor body 2 has a head 2*b* at one end of a shank 2*a* and a stopper 2*c* at the other end of said shank. Said fitment 3 may be screwed up into a retainer 4 provided on a concrete form F.

The fitment 3 is formed integral with the head 2*b* of the anchor body 2, including a base portion 31 covering the head 2*b*, a round bar portion 32 following of the base portion 31, and an external thread 33 which is shorter than one pitch and formed on the outer 2 periphery of said round bar portion. There is provided near the border between the base portion 31 and round bar portion 32 a smaller-diameter cross section consisting of a circumferential groove having an wedge-formed cross section, which provides an easy breaking portion 34.

The fitment 3 may be made of synthetic resin or metal, but considering that it must be easily broken by the easy breaking portion 34, the synthetic resin is preferable. Though the fitment 3 is formed integral with the anchor head 2*b* by means of synthetic resin, the base portion 31 of the fitment 3 separated from the anchor body 2 may be fitted to the head 2*b*. The external thread 33 may have a plurality of pitches, where the root of the thread 33 may provide the easy breaking portion 34.

The retainer 4 takes the shape of a short cylinder, having an inner hole 41 which is a little larger than the external thread 33 of the fitment 3 in diameter, and an internal thread 42 which is shorter than one pitch so that it may be engaged with the external thread 33. The material of the retainer 4 may be synthetic resin or metal, but considering that the retainer must withstand any repeated use and that it is to be welded to the concrete form F as shown in FIG. 1, metal is preferable.

The positioning member 5 is secured to the middle portion of said anchor shank 2*a*, and the former 1 is removably fitted onto said positioning member 5. The positioning member 5 is made of synthetic resin, and resin-bonded integral with the anchor shank 2*a*, having a short fitting cylinder portion 5*a* concentric with the shank 2*a*, a circumferential step portion 5*b*, and a gripping portion 5*c* all arranged in this order from the head 2*b*.

Then, the resin-molded and hemispherical shell-shaped former 1 is positioned in said circumferential step portion 5*b* so as to removably fit the short fitting cylinder portion 5*a*. The former 1 has a fitting hole 1*a* formed on the radius passing through the spherical top portion and spherical center thereof, and concentric with the spherical center. The fitting hole 1*a* is slightly larger than the head 2*b* in diameter. This may cause the former 1 to pass through the anchor head 2*b* to be fitted onto the positioning member 5.

Figure 4:
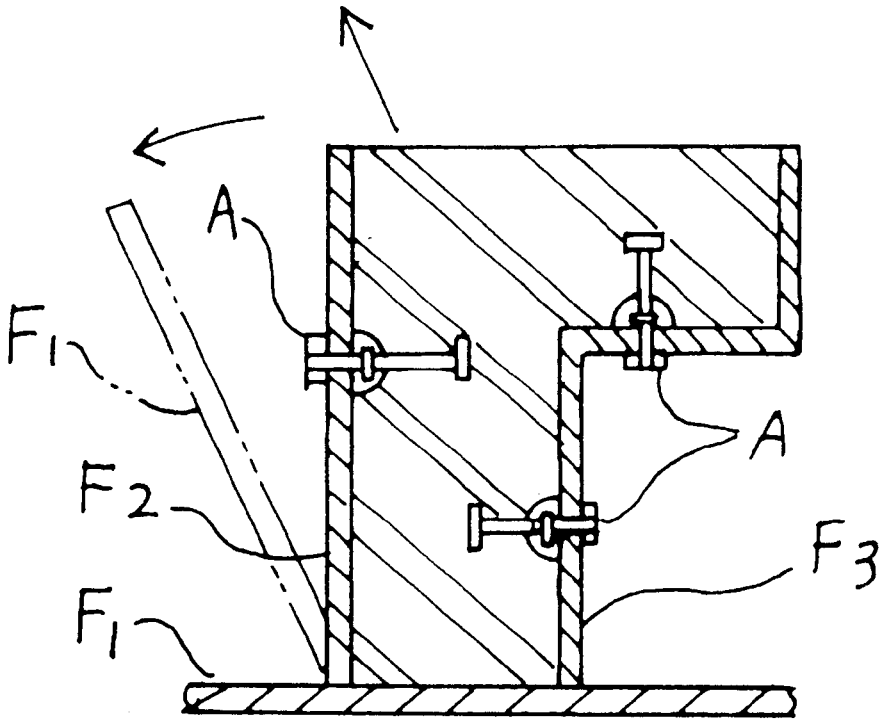
FIG. 4 is a sectional explanatory view showing the attachment and detachment of the form in sequence.

Next, the method of manufacturing concrete-molded piece using said anchor A will be described with reference to FIGS. 1 and 4. First, as shown by FIG. 1, the retainer 4 is securely welded to the outer side of the form F provided with a through-hole F0 which is larger than the external thread 33 of the fitment 3 in diameter. Then, the anchor head 2*b* is passed through the hole 1*a* and the former 1 is fitted onto the positioning member 5 of the anchor body 2.

Then, while holding the gripping portion 5*c* of the positioning member by hand, the fitment 3 of the anchor body 2 is inserted into the inner hole 41 through the through-hole F0 of the concrete form F and the external and internal threads 33, 42 are meshed with each other. Since the threads are made shorter than one pitch respectively, after inserted, the fitment 3 is given a slight turn and both the threads will be simply meshed with each other and held tight.

Thus, the anchor A can be attached to the concrete form F by firmly joining the end of the former 1 on the inside of the concrete form A. Then, as shown in FIG. 4, side forms F2, F3 are placed upright on the upper face of a lower form F1, and concrete is poured. After the applied concrete has hardened, first, the side form F2 is brought down to remove the concrete form F, and then, with the side form F3 fixedly positioned at the lower portion thereof, the anchor head 2*b* is hung on a lifting device so as to lift the concrete molded piece diagonally and upwardly (arrow).

At this time, a breaking force is applied between the anchor head 2*b* at the concrete molded piece side and the fitting portion 31 at the form F side, and the easy breaking portion 34 is readily broken down. Consequently there remain the anchor body 2, former 1, and positioning member 5 in the concrete molded piece.

The fitment 3 remaining within the inner hole 41 of the retainer 4 is easy to remove because it is in engaged position by means of threads which are shorter than one pitch. If the former 1 is removed therefrom, it can be used repeatedly.

Figure 5:
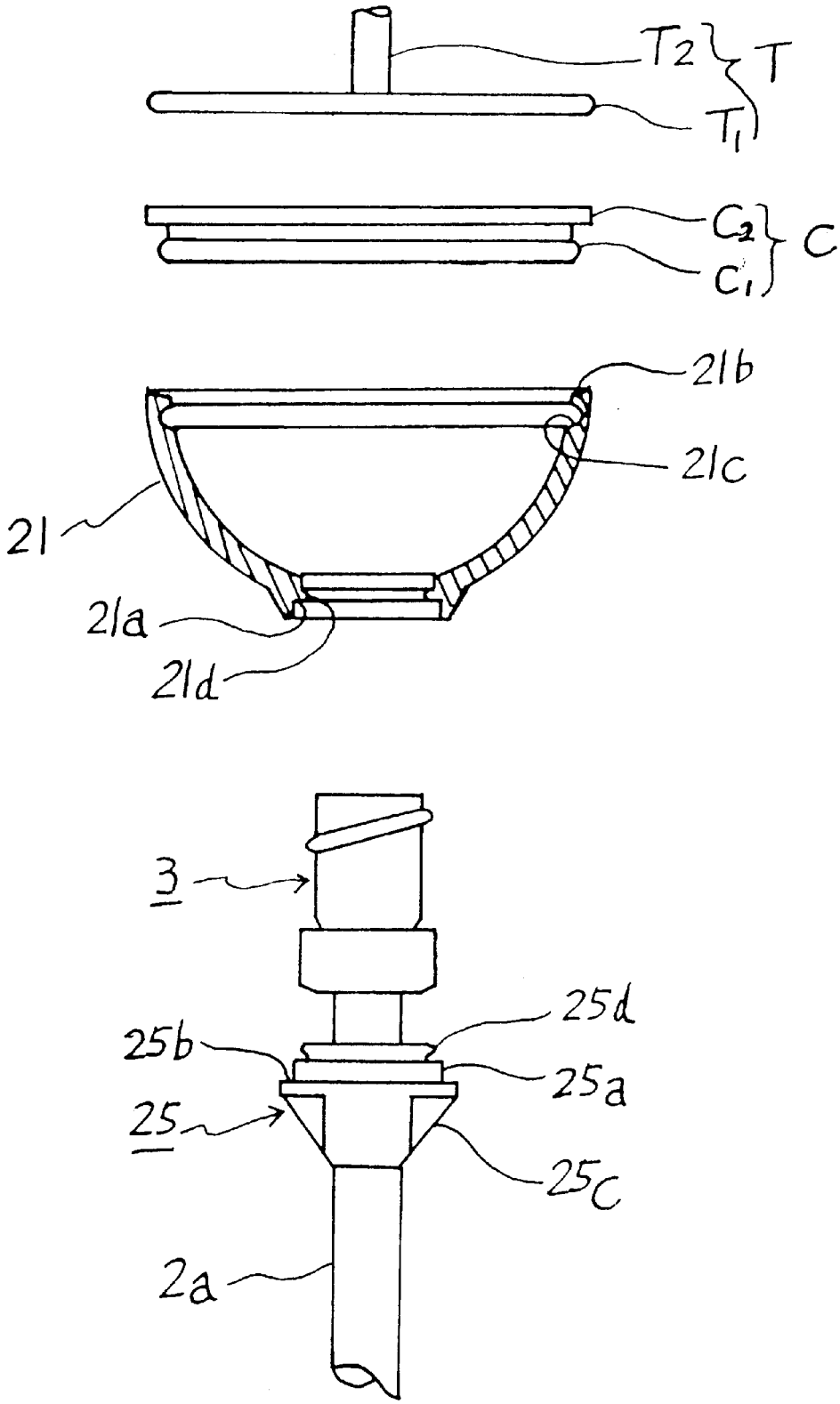
FIG. 5 is an exploded longitudinal sectional view showing another embodiment (second embodiment) of the present invention.

FIG. 5 illustrates another embodiment (a second embodiment). The end face of a former 21 provides a tapered face 21*b* which becomes lower radially and inwardly. With such an arrangement, if the external thread 33 of the fitment is screwed into the retainer 4 at the concrete form side, the region near the end face of the former 21 is pressed to the face of the concrete form, whereby such a region is subjected to elastic deformation to slightly expand in diameter, and said tapered face 21*b* will be firmly attached along by and to the form face. Concrete solution may be assuredly prevented from entering into the inner side of the former 21 accordingly.

There is formed at the inside close to the end face of the former 21 a circumferential groove 21*c* extending substantially parallel with the end face, the breadthwise cross section of this groove has the shape of a semicircle. This facilitates elastic deformation in the end face of said former 21. While a dismantling tool T (having a handle T2 standing upright in the center of a disc T1 which is to be fitted into the circumferential groove 21*c*) as shown in the drawing is engaged in the circumferential groove 21*c*, and when the handle T2 is manipulated, the former 21 will be removed from the positioning member 25, and if the handle T2 is pulled forward, the former 21 will come out of the anchor body 2 while it is kept in engagement with the disc T1. Consequently, the former 21 can be reused.

Furthermore, a cap C as shown in the drawing (an outer disc C2 is concentrically formed integral with a disc C1 having a circumferential raised streak which may be fitted into the circumferential groove 21*c*, and this outer disc C2 is large enough to cover the end face of the former 21) may be removably mounted in said former circumferential groove 21C. This can avoid any collection and freezing of rainwater or snow. When the cap C is to be put on the former 21, the end of the former 21 is covered with and pressed by the cap C, the end face of the former 21 is expanded from elastic deformation, and the circumferential raised streak of the cap C is fitted into the circumferential groove 21*c* of the former 21. When the cap C is to be removed, a dismantling tool such as a driver is inserted into a gap formed between the outer disc C2 and the former 21 to prize out the cap C.

The fitting hole 21*a* of the former 21 has circumferential raised and depressed streaks 21*d* allows of loading and unloading by elastic deformation. There is provided on the short fitting cylinder portion 25*a* of said positioning member 25 circumferential raised and depressed streaks 25*d* which may be removably fitted with said circumferential raised and depressed streaks 21*d* by elastic deformation. This may cause the former 21 to be reliably and removably mounted to the positioning member 25. The gripping portion 25*c* of the positioning member 25 includes a rib (or polygonal member) which serves as an anti-slip means against the manual control of turning.

Figure 6:
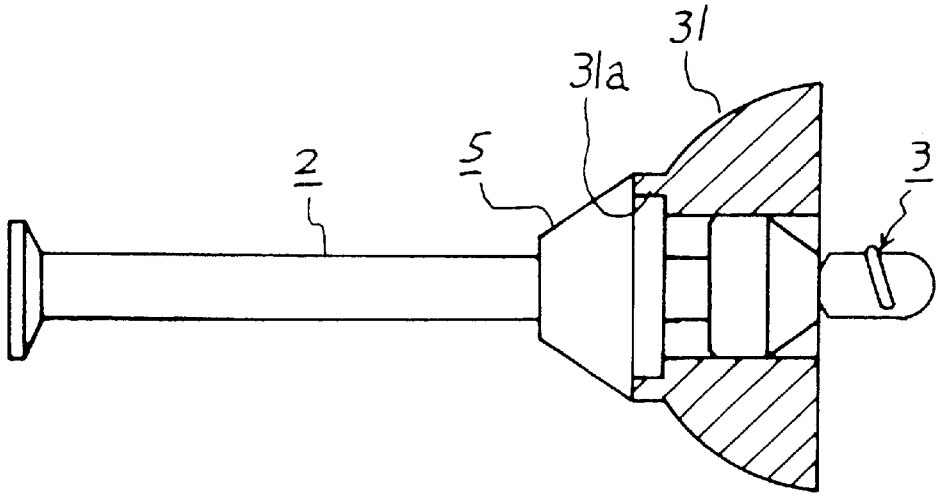
FIG. 6 is a longitudinal sectional view showing a third embodiment of the present invention.
Figure 7:
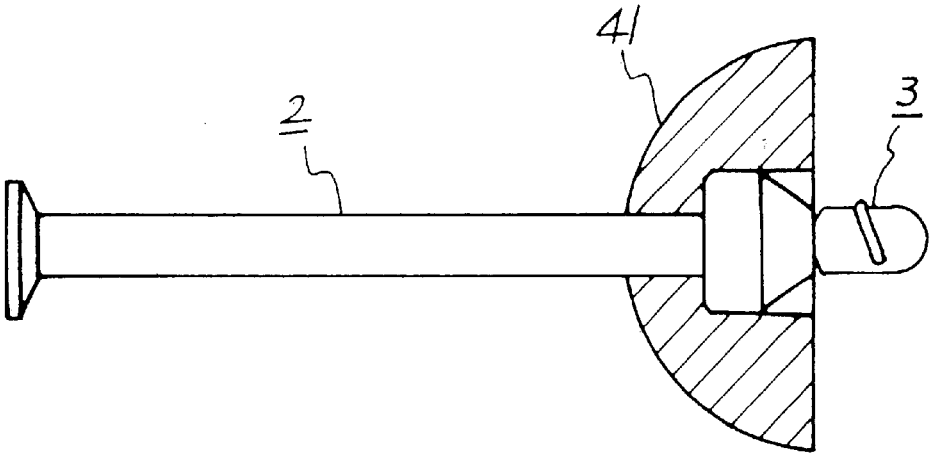
FIG. 7 is a longitudinal sectional view showing a fourth embodiment of the present invention.
Figure 8:
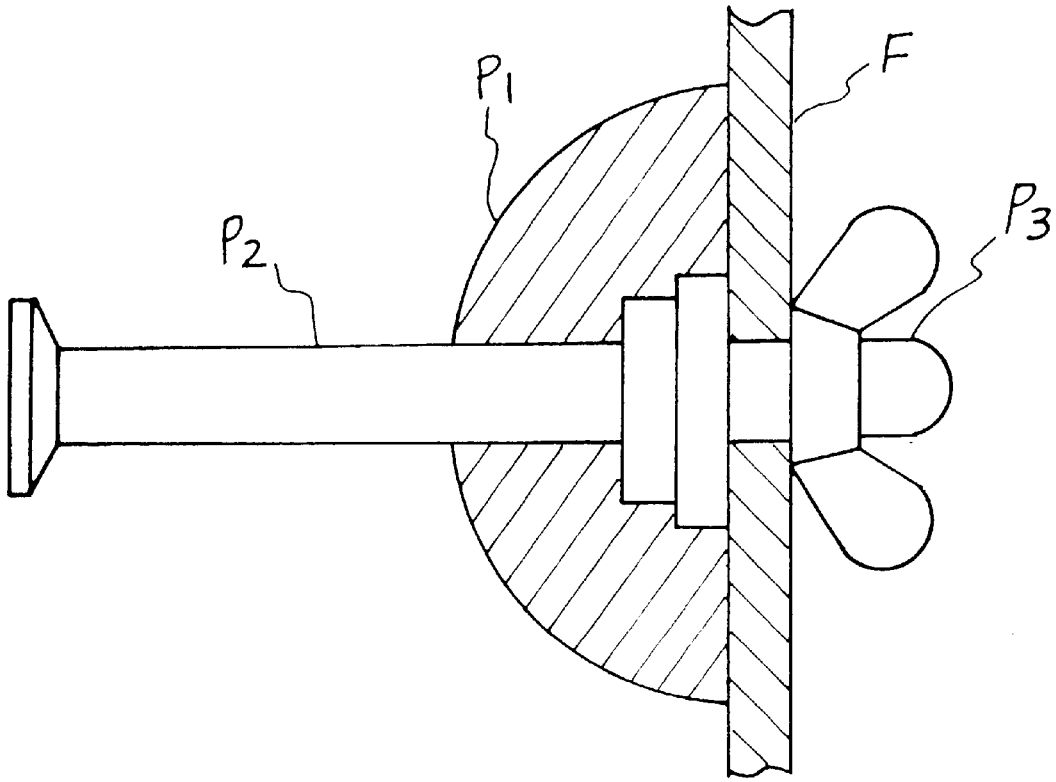
FIG. 8 is a longitudinal sectional view showing a prior art anchor.
Figure 9:
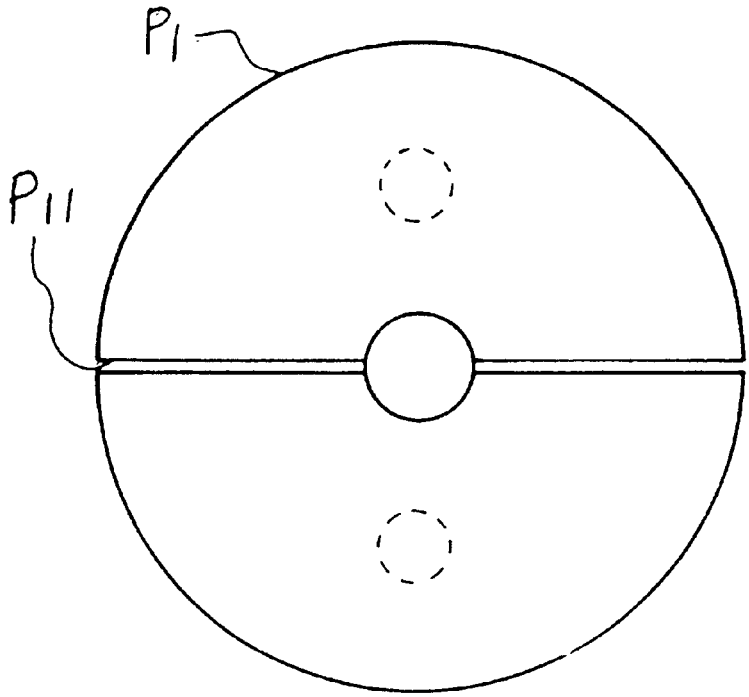
FIG. 9 is a left side view of FIG. 8
Figure 10:
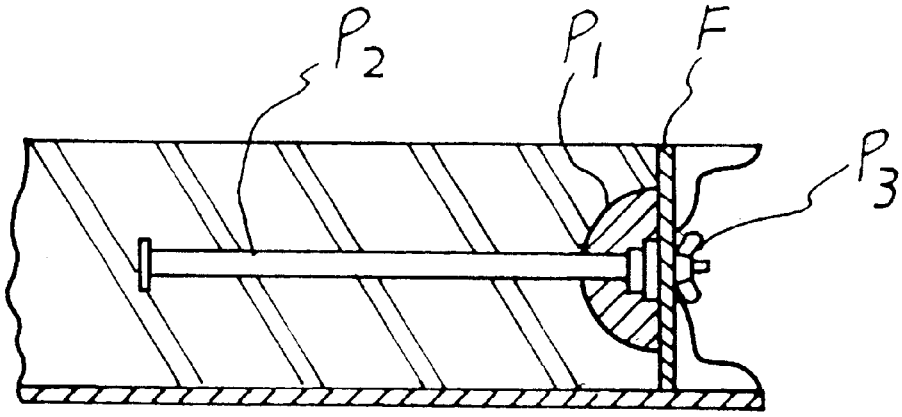
FIG. 10 is a explanatory view of prior art operation.
Figure 11:
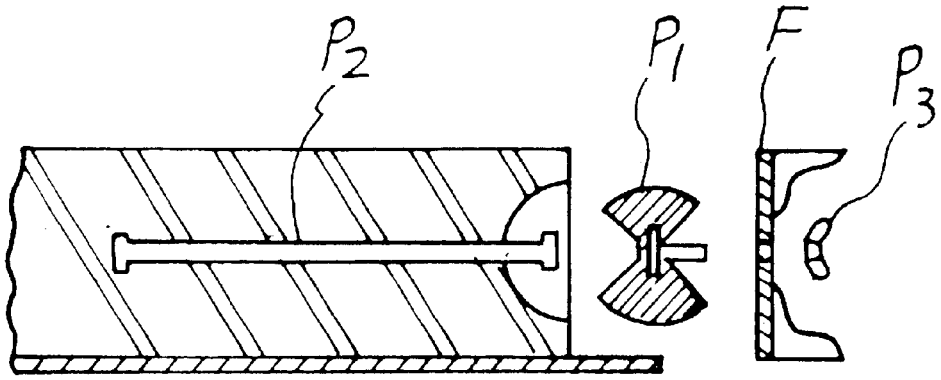
FIG. 11 is a explanatory view of prior art operation.
Figure 12:
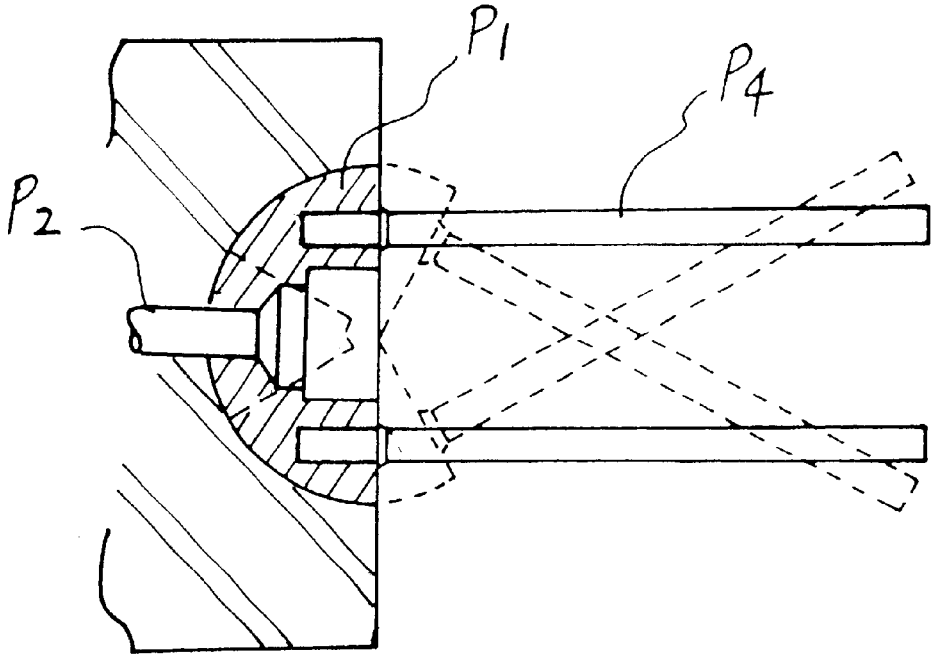
FIG. 12 is a explanatory view of prior art operation.

FIG. 6 shows a third embodiment. A former 31 is shaped like a hemisphere and has a fitting hole 31*a* which may receive an anchor head 2*b*. FIG. 7 shows a fourth embodiment. A former 41 is shaped like a hemisphere, and has a cut portion which is formed to extend on the diameter passing through the spherical top from the top to near the bottom portion, whereby the former 41 can open and shut (same as prior art shown in FIGS. 8 and 9). Said former 41 is opened at said cut such that it may encase said anchor bead 2*b* therein. In these embodiments, the formers 31, 41 are taken away from the molded piece after removal of the concrete form.

Figure 2:
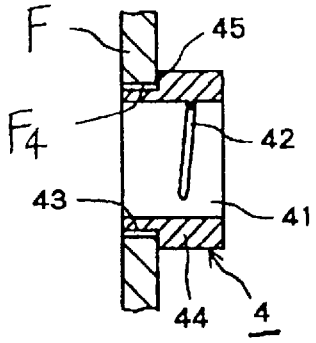
FIG. 2 is a longitudinal sectional view of another embodiment of the retainer of the present invention.

FIG. 2 illustrates an embodiment including a different type of retainer 4. The cylindrical retainer 4 has an external thread 43 formed on its outer periphery at one end side, which external thread being engaged in an inner thread F4 provided on the concrete form F. And the retainer 4 may be securely fixed by bringing a step portion 45, which demarcates a tubular portion 44 that is larger than the external thread 43 in diameter, into contact with the concrete form F.

Figure 3:
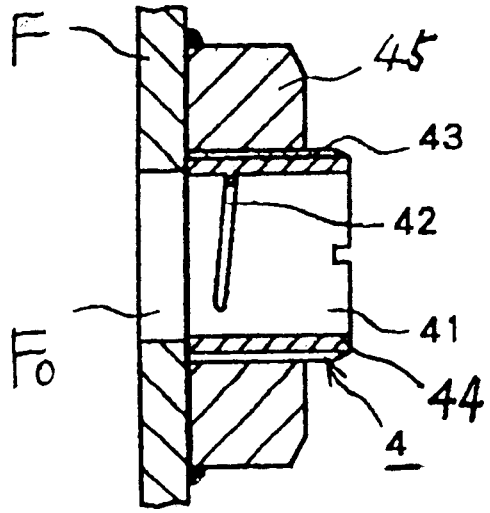
FIG. 3 is a longitudinal sectional view of further embodiment of the retainer of the present invention.

FIG. 3 shows another embodiment of retainer 4, which comprises tubular portion 44 and a nut 45. An external thread 43 is formed over the entire outer periphery of the tubular portion 44, while an inner thread 42 is formed in an inner hole 41. The inner hole 41 of the tubular portion 44 where the nut 45 fitted is aligned with a through-hole F0 of the concrete form F, and the nut 45 is fixedly welded to the concrete form F.

The retainer (inner thread member) 4 may be fixed in a manner that it is protruded from inner side face of the concrete form F (at the concrete side) provided with the through-hole F0. The through-hole may be omitted from concrete form F and the retainer 4 may be provided in the inner side of the concrete form F instead.

Figure 13:
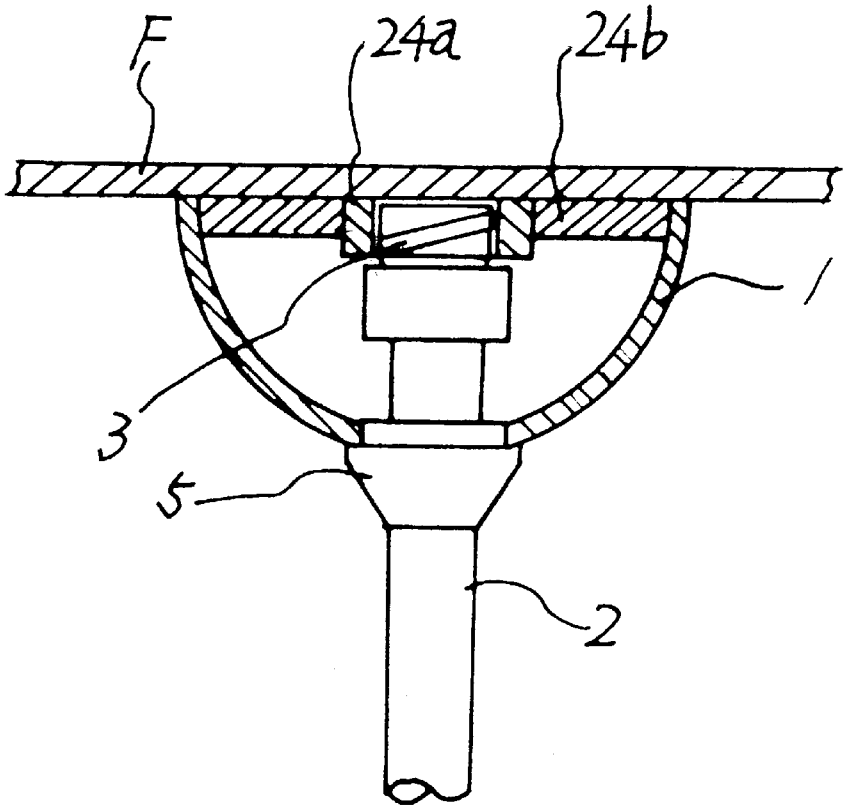
FIG. 13 is a longitudinal sectional view of further embodiment of the retainer of the present invention.

Referring to FIG. 13, use is made of a retainer (inner thread member) 24*a* which is fixed concentrically in the center of a magnetic disc 24*b*. The use of the magnetic disc 24*b* attached to the inner side of a concrete form made of metal (steel etc.) of a magnetic induction type may facilitates the positioning of the retainer relative to the concrete form, which may avoid the necessity of welding through-hole or retainer to the concrete form. In this embodiment, though the former 1 is fitted onto the outer peripheral face of the magnetic disc 24*b* by the inner side of the leading end thereof, this arrangement is not essential. The disc 24*b* may be omitted and the retainer 24*a* may be constituted by a magnet instead.

Figure 14:
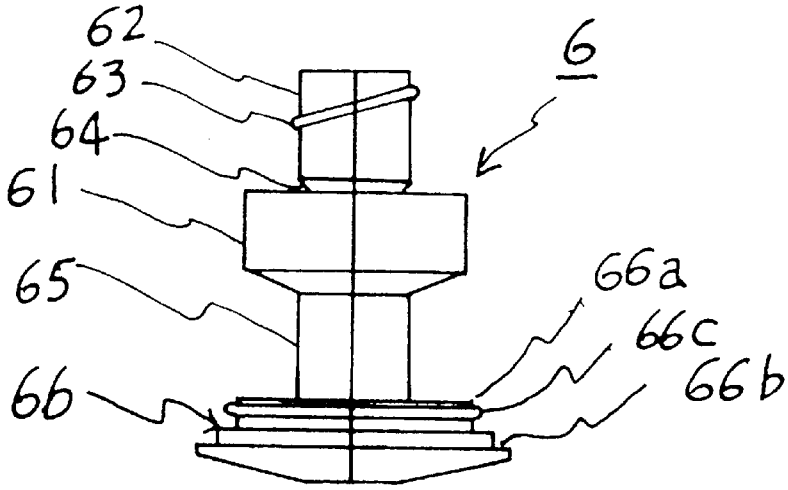
FIG. 14 is a front view of another embodiment of the fitment of the present invention.
Figure 15:
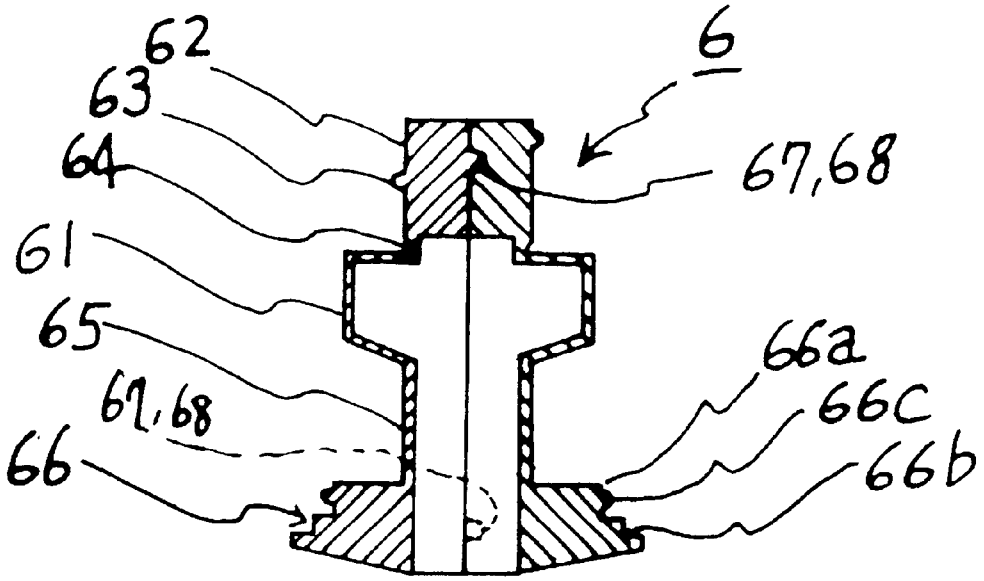
FIG. 15 is a longitudinal sectional view of another embodiment of the fitment of the present invention.
Figure 16:
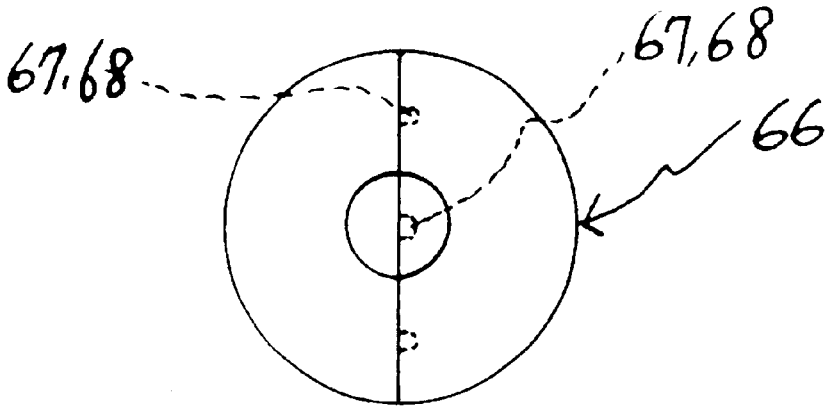
FIG. 16 is a bottom view of another embodiment of the fitment of the present invention.

FIGS. 14–16 show another embodiment 6 of the fitment 3 which can be removably fitted onto the head 2*b* and the shank 2*a* of the anchor body 2. The fitment 6 has a base portion 61 covering the head 2*b*, a round bar portion 62 following the base portion 61, an external thread 63 formed on the outer periphery of said round bar portion, an easy breaking portion of a smaller-diameter cross section 64 provided near the border between the base portion 61 and round bar portion 62, and a positioning part 66 connected to the base portion 61 via a joining cylinder part 65.

Similar to the above embodiment (FIG. 5), the positioning part 66 has a short fitting cylinder portion 25*a*, a circumferential step portion 66*b*, and a circumferential raised and depressed streaks 25*c* provided on the short fitting cylinder portion 25*a*. A circumferential raised and depressed streaks 21*d* of the former 21 is removably fitted to the said circumferential raised and depressed streaks 25*c* by elastic deformation.

The fitment 6 is splitted on a plane including it's axis, and able to split and combine by male and female joint of elastic deformation composed of dowel 67 and depression 68 (one set on the round part 62 and two sets on the positioning part 66). These parts are made of synthetic resin.

When manufacturing concrete-molded piece, first, the fitment 6 is combined with the anchor body 2 via the dowel 67 and the depression 68. Next similar to the above, the former 21 is fitted onto the positioning part 66 and the external threads 63 is meshed with the through-hole F0 of the concrete form F.

Concrete is poured and after removing the concrete form, similar as the above, the easy breaking portion 65 of the fitment 6 is readily broken down, with the consequence that there remain the round bar portion 62 in the form F and another parts on the anchor body 2.

After that, another parts of the fitment 6 on the anchor body 2 are utilized as a concrete molded piece, as it is. Or, former 21 is removed, or the fitment 6 is also removed via the 67 and depression 68.

Figure 17:
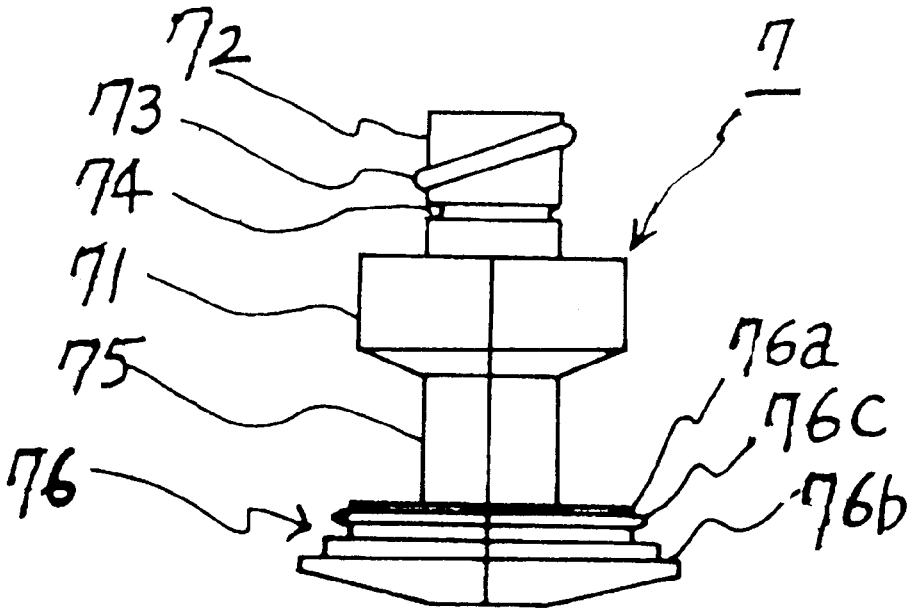
FIG. 17 is a front view of still more another embodiment of the fitment of the present invention.
Figure 18:
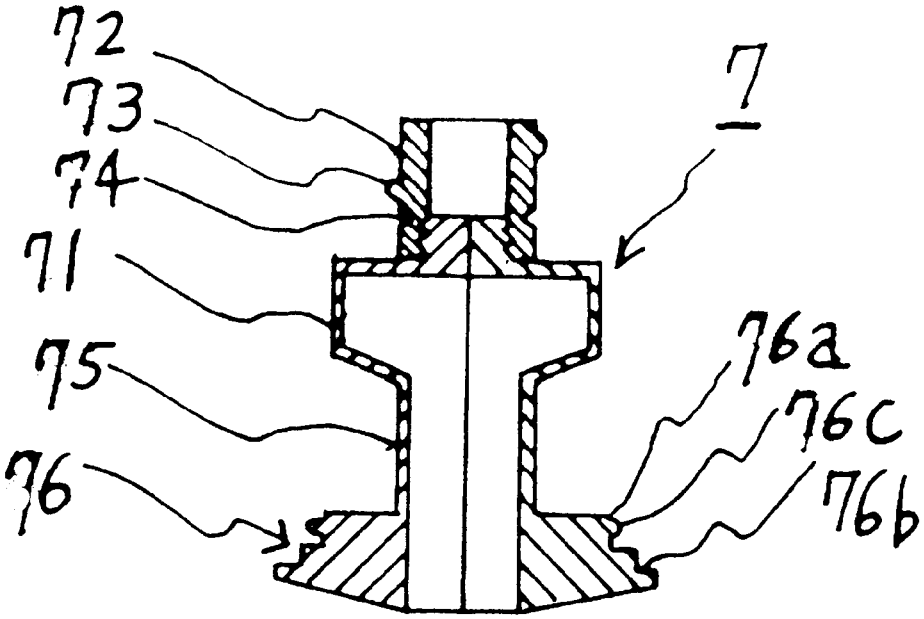
FIG. 18 is a longitudinal sectional view of another embodiment of the fitment of the present invention.
Figure 19:
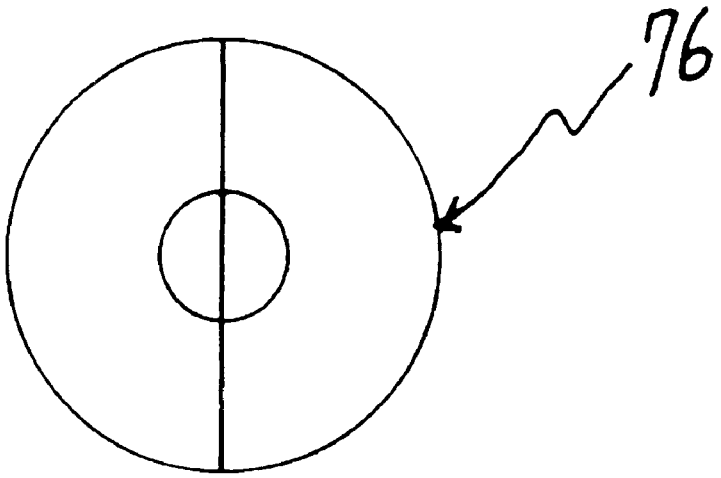
FIG. 19 is a bottom view of another embodiment of the fitment of the present invention.

FIGS. 17–19 show another embodiment 7 of the fitment 3 which can be removably fitted onto the head 2*b* and the shank 2*a* of the anchor body 2. The fitment 7 has a base portion 71 covering the head 2*b*, a round bar portion 72 following the base portion 71, an external thread 73 formed on the outer periphery of said round bar portion, an easy breaking portion of a smaller-diameter cross section 74 provided near the border between the base portion 71 and round bar portion 72, and a positioning part 76 connected to the base portion 71 via a joining cylinder part 75.

The base portion 71, the joining cylinder part 75 and the positioning part 76 are splitted on a plane including their axis. Against the base portion 71, different cylindrical part formed by the round bar portion 72, the external thread 73 and the smaller-diameter cross section 74 can be removably fitted, by means of a connecting thread composed of an internal thread 72*a* and an external thread 71*a* (splitted) integrally formed with the base portion 71. Here, the smaller-diameter cross section 74 situates on the boarder between a meshing part of the internal thread 72*a* of the round bar portion 72 with the external thread 71*a* and the other part.

When manufacturing concrete-molded piece, first, two splitted parts of the base portion 71, the joining cylinder part 75 and the positioning part 76 are put on the anchor body 2. Next, cylindrical part formed by the round bar portion 72, the external thread 73 and the smaller-diameter cross section 74 is meshed with by means of a connecting thread 71*a*, 72*a*. Next the former 21 is fitted onto the positioning part 76. After that, operation is done similar to the above.

After removing the concrete form, there remain a part of the round bar portion 72 on the base portion 71 by connecting thread 71*a*, 72*a*. Then, the fitment 7 and the former 21 are utilized as it is. Or, when the former 21 and the part of the round bar portion 72 are removed, the fitment 7 remained is removed from the anchor body 2.

The former 1 may be secured to the anchor body 2. The positioning member 5 is not provided, and the former 1 may be directly fixed to the anchor body 2.

The suitable thickness of resin coating on the top of the anchor head is about 3 mm. The suitable thickness of resin coating applied on the side face and the lower face of the anchor head, and a part of the shank extending from the lower face of the anchor head to the positioning member 5 are something between about 0.5 mm and 1 mm. This may keep these parts free of rust.

The use of the anchor in accordance with the present invention makes it possible to mount the anchor by the operation from the outside without making positional alignment in the inside and outside of the form, so that a single person will do for executing the mounting operation. And besides, when removing the concrete form, without removal of screws, the concrete form and anchor can be simply separated from each other only by removing the concrete form or lifting the concrete molded piece, which may ensure a great improvement of efficiency and safety in operation.

If the fitment and retainer are combined by means of threads which are shorter than one pitch, the anchor can be simply mounted to the concrete form for a short period of time, and the fitment left behind can be easily removed after the concrete form has been taken away, so that the concrete form and retainer can be reused.

If the fitment is formed integral with the anchor body, the construction will be of a simple type and the mounting operation will not require much time and labor. Furthermore, a fitment made of synthetic resin would facilitate breaking at the easy breaking portion, and thus such a breaking action requires no big force.

The hemispherical shell-shaped former has the following excellent effects. That is, when the concrete molded piece is lifted in such a direction that the anchor shank may be curbed, the concrete former will be burdened with a part of load applied then, which may lead to prevention of breakage of the anchor. If the anchor is embedded in the side of the molded piece, the anchor will jut out a long way in a horizontal direction at the time when the anchor is set on a concrete form standing in a upright position. The anchor body is supported by the former, while the latter sticks fast to the concrete form, whereby the anchor body may be prevented from leaning when the concrete forming takes place to ensure that the anchor will be put in position. And in addition, as the cap can be easily attached to and detached from the former, so that the installation of the cap enables prevention of freezing of rainwater or snow which may collect in the recession of the concrete former.

With a concrete former having a tapered end face which gets lower radially and inwardly, when a external thread of the fitment is screwed up into the retainer at the concrete form side, the tapered face is firmly attached along to the face of the concrete form, thus assuredly preventing the concrete solution from entering into the concrete former.

If a circumferential groove is formed in the inner side near the end of the concrete former in a manner that said groove will run substantially in parallel with said end, the concrete former is easily subjected to elastic deformation at the end thereof. The concrete former can be easily removed from the positioning member by a dismantling tool which has been brought in engagement with said circumferential groove. Furthermore, the cap may be removably mounted to this circumferential groove.

If circumferential raised and depressed streaks, which are elastically deformable and fitted to each other, are Provided in the fitting hole of the former and positioning member, the former may be assuredly and removably mounted to the positioning member.

If the fitment can be removably fitted onto the anchor body, only the fitment can be easily formed by means of synthetic resin, in comparison with forming integrally with the anchor body.

If different from the base portion, the round bar portion, the external thread and the easy breaking portion can be removably fitted, by means of a connecting thread, following effect are obtained. After removing the concrete form, there remain a part of the round bar portion on the base portion. Then, the base portion, the joining cylinder and the positioning part are remained on the anchor body in a good state. And when the former and the part of the round bar portion are removed, the base portion, the joining cylinder and the positioning part can be removed and utilized again.

The present invention is not limited to the aforementioned examples and embodiments, and includes different variations without departing from the spirit and scope as defined in the appended claims.

What is claimed is:

1. A concrete embedding anchor which comprises:

an anchor body having a head formed in one end of the shank and a stopper in the other end, a fitment concentrically mounted to the head and having an external thread and easy breaking portion formed on the round bar portion, a positioning member fixed to the middle portion of said anchor shank, and a former engaged with said positioning member.

2. A concrete embedding anchor according to claim 1 which comprises:

said former is a hemispherical shell-shaped object.

3. A concrete embedding anchor according to claim 2 which comprises:

said former has a circumferential groove formed in an internal position near the end thereof to extend substantially in parallel with the end.

4. A concrete embedding anchor according to claim 2 which comprises:

said former has a fitting hole formed on the radius passing through the spherical top and spherical center and concentrical therewith, said fitting hole being slightly larger than said anchor head in diameter, and circumferential raised and depressed streaks which may attach to and detach from by deforming elastically, an another circumferential raised and depressed streaks which may attach to and detach from said streaks by deforming elastically is provided on said positioning member.

5. A concrete embedding anchor according to claim 2 which comprises:

a cap having a circumferential raised streak which is removably fitted in the circumferential groove of said former.

6. A concrete embedding anchor according to claim 1 which comprises:

said former is in the shape of a hemisphere.

7. A concrete embedding according to claim 1 which comprises:

said external thread formed on the round bar portion of said fitment is shorter than one pitch.

8. A concrete embedding anchor according to claim 7 which comprises:

said fitment and said positioning member being removably fitted onto said head and said shank of said anchor body, and having a base portion covering said head, a round bar portion following said base portion, an external thread formed on said outer periphery of said round bar portion, an easy breaking portion of a smaller-diameter cross section provided near said border between said base portion and said round bar portion, a joining cylinder part connected to said base portion, and a positioning part connected to said base portion via said joining cylinder part, and being splitted on a plane including it's axis, and able to split and combine by male and female joint of elastic deformation.

9. A concrete embedding anchor according to claim 7 which comprises:

said fitment and said positioning member being removably fitted onto said head and said shank of said anchor body, and having a base portion covering said head, a round bar portion following said base portion, an external thread formed on said outer periphery of said round bar portion, an easy breaking portion of a smaller-diameter cross section provided near said border between said base portion and said round bar portion, a joining cylinder part connected to said base portion, and a positioning part connected to said base portion via said joining cylinder part, said base portion, said joining cylinder part and said positioning part being splitted on a plane including their axis, against said base portion, different cylindrical part formed by said round bar portion, said external thread and said smaller-diameter cross section being removably fitted, by means of a connecting thread composed of an internal thread and an external thread splitted integrally formed with said base portion.

10. A concrete embedding anchor according to claim 1 or 2 or 6 or 4 which comprises:

said fitment and said positioning member being removably fitted onto said head and said shank of said anchor body, and having a base portion covering said head, a round bar portion following said base portion, an external thread formed on said outer periphery of said round bar portion, an easy breaking portion of a smaller-diameter cross section provided near said border between said base portion and said round bar portion, a joining cylinder part connected to said base portion, and a positioning part connected to said base portion via said joining cylinder part, and being splitted on a plane including it's axis, and able to split and combine by male and female joint of elastic deformation.

11. A concrete embedding anchor according to claim 1 or 2 or 6 or 4 which comprises:

said fitment and said positioning member being removably fitted onto said head and said shank of said anchor body, and having a base portion covering said head, a round bar portion following said base portion, an external thread formed on said outer periphery of said round bar portion, an easy breaking portion of a smaller-diameter cross section provided near said border between said base portion and said round bar portion, a joining cylinder part connected to said base portion, and a positioning part connected to said base portion via said joining cylinder part, said base portion, said joining cylinder part and said positioning part being splitted on a plane including their axis, against said base portion, different cylindrical part formed by said round bar portion, said external thread and said smaller-diameter cross section being removably fitted, by means of a connecting thread composed of an internal thread and an external thread splitted integrally formed with said base portion.

12. A concrete embedding anchor which comprises:

an anchor body having a head at one end of the shank and a stopper at the other end, a positioning member fixed to the middle portion of said anchor shank, and a former fitted to said positioning member.

13. A concrete embedding anchor which comprises:

an anchor body having a head at one end of the shank and a stopper at the other end, and a positioning member fixed to the middle portion of said anchor shank.

14. A fitment for a concrete embedding anchor which comprises:

said fitment being removably fitted onto an anchor body having a head formed in one end of a shank thereof and a stopper in the other end, and having a base portion covering said head, a round bar portion following said base portion, an external thread formed on said outer periphery of said round bar portion, an easy breaking portion of a smaller-diameter cross section provided near said border between said base portion and said round bar portion, a joining cylinder part connected to said base portion, and a positioning part connected to said base portion via the joining cylinder part, and being splitted on a plane including it's axis, and able to split and combine by male and female joint of elastic deformation.

15. A fitment for a concrete embedding anchor which comprises:

said fitment being removably fitted onto an anchor body having a head formed in one end of a shank thereof and a stopper in the other end, and having a base portion covering said head, a round bar portion following said base portion, an external thread formed on said outer periphery of said round bar portion, an easy breaking portion of a smaller-diameter cross section provided near said border between said base portion and round bar portion, a joining cylinder part connected to said base portion, and a positioning part connected to said base portion via said joining cylinder part, said base portion, said joining cylinder part and said positioning part being splitted on a plane including their axis, against said base portion, different cylindrical part formed by said round bar portion, said external thread and said smaller-diameter cross section being removably fitted, by means of a connecting thread composed of an internal thread and an external thread splitted integrally formed with said base portion.

16. A method of manufacturing concrete molded piece using a concrete embedding anchor which comprises:

utilizing an anchor including an anchor body having a head at one end of the shank and a stopper at the other end, a fitment concentrically mounted to said head and having an external thread and easy breaking portion formed on the round bar portion thereof, and a hemispherical shell-shaped former fitted with the middle portion of said anchor shank, securing retainer to the concrete form in advance, inserting said anchor fitment into and screwing up to said retainer, for combining said anchor with said concrete form, pouring concrete, and taking away said concrete form after the concrete has hardened.

17. A method of manufacturing concrete molded piece using a concrete embedding anchor which comprises:

utilizing an anchor including an anchor body having a head at one end of the shank and a stopper at the other end, a fitment concentrically mounted to said head and having an external thread and easy breaking portion formed on the round bar portion thereof, a positioning member, fixed to the middle portion of said anchor shank, and a former removably fitted to said positioning member, securing retainer to the concrete form in advance, inserting said anchor fitment into and screwing up to said retainer, combining with the concrete form, pouring concrete, taking away said concrete form after the concrete has hardened, and removing said former left behind in a molded piece.

18. A method of manufacturing concrete molded piece using a concrete embedding anchor which comprises:

(a) utilizing an anchor including an anchor body having a head at one end of the shank and a stopper at the other end, a fitment having a positioning part, a former removably fitted to said positioning part, said fitment being removably fitted onto said head and said shank of said anchor body, and having (1) a base portion covering said head, (2) a round bar portion following said base portion, (3) an external thread formed on said outer periphery of said round bar portion, (4) an easy breaking portion of a smaller-diameter cross section provided near said border between said base portion and said round bar portion, (5) a joining cylinder part connected to said base portion, (6) and a positioning part connected to said base portion via said joining cylinder part, (7) and being splitted on a plane including it's axis, and able to split and combine by male and female joint of elastic deformation, (b) securing retainer to the concrete form in advance, (c) inserting said anchor fitment into and screwing up to said retainer for combining with the concrete form, (d) pouring concrete, (e) taking away said concrete form after the concrete has hardened, (f) and removing said former and said fitment left behind in a molded piece.

19. A method of manufacturing concrete molded piece using a concrete embedding anchor which comprises:

(a) utilizing an anchor including an anchor body having a head at one end of the shank and a stopper at the other end, a fitment having a positioning part, a former removably fitted to said positioning part, said fitment being removably fitted onto said head and said shank of said anchor body, and having (1) a base portion covering said head, (2) a round bar portion following said base portion, (3) an external thread formed on said outer periphery of said round bar portion, (4) an easy breaking portion of a smaller-diameter cross section provided near said border between said base portion and said round bar portion, (5) a joining cylinder part connected to said base portion, (6) and a positioning part connected to said base portion via said joining cylinder part, (7) said base portion, said joining cylinder part and said positioning part being splitted on a plane including their axis, (8) against said base portion, different cylindrical part formed by said round bar portion, said external thread and said smaller-diameter cross section being removably fitted, by means of a connecting thread composed of an internal thread and an external thread splitted integrally formed with said base portion, (b) securing retainer to the concrete form in advance, (c) inserting said anchor fitment into and screwing up to said retainer for combining with the concrete form, (d) pouring concrete, (e) taking away said concrete form after the concrete has hardened, (f) and removing said former and said fitment left behind in a molded piece.

* * * * *